US010857428B2

(12) United States Patent
Lin

(10) Patent No.: US 10,857,428 B2
(45) Date of Patent: Dec. 8, 2020

(54) LUMINOUS BALL WITH REMOTE ACTIVATION CAPABILITY

(71) Applicant: Blackstar Corp., New Taipei (TW)

(72) Inventor: Wei-Hung Lin, New Taipei (TW)

(73) Assignee: BLACKSTAR CORP., New Taipei (TW)

( * ) Notice: Subject to any disclaimer, the term of this patent is extended or adjusted under 35 U.S.C. 154(b) by 0 days.

(21) Appl. No.: 16/668,091

(22) Filed: Oct. 30, 2019

(65) Prior Publication Data

US 2020/0139203 A1 May 7, 2020

(30) Foreign Application Priority Data

Nov. 2, 2018 (TW) ..... 107138994 A

(51) Int. Cl.
*A63B 43/06* (2006.01)
*A63B 102/18* (2015.01)

(52) U.S. Cl.
CPC ..... *A63B 43/06* (2013.01); *A63B 2102/18* (2015.10); *A63B 2207/02* (2013.01); *A63B 2225/54* (2013.01)

(58) Field of Classification Search
CPC . A63B 43/06; A63B 2225/54; A63B 2102/18; A63B 2207/02; A63B 37/12;
(Continued)

(56) References Cited

U.S. PATENT DOCUMENTS 3,011,048 A * 11/1961 O'Brien ..... F21V 15/04 473/570
4,261,565 A * 4/1981 Massino, Sr. ..... A63B 37/06 156/186

(Continued)

FOREIGN PATENT DOCUMENTS

CN 206777747 U 12/2017
TW M528190 U 9/2016
TW M565052 U 8/2018

OTHER PUBLICATIONS

"Cells, comb, hexagon, hexagonal, honey, honeycomb, pattern icon", <<https://www.iconfinder.corn/icons/1868797/cells_comb_hexagon_hexagonal_honey_honeycomb_pattern_icon>>, retrieved on Apr. 17, 2020. (Year: 2020).*

*Primary Examiner* — Steven B Wong
(74) *Attorney, Agent, or Firm* — Li & Cai Intellectual Property (USA) Office

(57) ABSTRACT

A luminous ball with remote activation capability includes a sphere, a cover and a light-emitting device. The cover wraps an external circumferential surface of the sphere and is made of a light-transmissive material. At least one seam is formed on the cover, and a plurality of seam apertures are disposed in pairs along two sides of the at least one seam. The light-emitting device is disposed in the sphere and includes a light-emitting unit, a power unit, a wireless transmitter-receiver unit and a main control unit. The main control unit is operably configured to provide an electrical connection between the light-emitting unit and the power unit after obtaining an activation signal received by the wireless transmitter-receiver unit such that light emitted by the light-emitting unit penetrates the sphere and the cover and is visible through the at least one seam and the plurality of seam apertures.

12 Claims, 11 Drawing Sheets

(58) Field of Classification Search
CPC ..... A63B 37/02; A63B 37/04; A63B 43/004; A63B 43/008; A63B 39/02; A63B 37/06; A63B 2039/003
See application file for complete search history.

(56) References Cited

U.S. PATENT DOCUMENTS 6,142,894 A * 11/2000 Lee ..... A63B 43/00 446/397
7,614,959 B1 * 11/2009 Gentile ..... A63B 24/0021 463/30
8,727,918 B1 * 5/2014 Gentile ..... A01K 15/025 473/570
9,821,196 B2 * 11/2017 Lin ..... A63B 43/06
10,159,874 B1 * 12/2018 Lin ..... A63B 43/06
2001/0049311 A1 * 12/2001 Lewis ..... A63B 43/06 473/570
2005/0096157 A1 * 5/2005 Huang ..... A63B 37/0003 473/351
2005/0261083 A1 * 11/2005 Liao ..... A63B 24/0021 473/353
2007/0173349 A1 * 7/2007 Eng ..... A63B 43/06 473/353
2010/0069181 A1 * 3/2010 Lin ..... A63B 43/06 473/570
2011/0218065 A1 * 9/2011 Cavallaro ..... A63B 41/00 473/603
2011/0244981 A1 * 10/2011 Schrimmer ..... A63B 37/0003 473/353
2014/0256478 A1 * 9/2014 Gale ..... A63B 41/085 473/465
2014/0274504 A1 * 9/2014 Hu ..... A63B 39/00 473/604
2014/0277636 A1 * 9/2014 Thurman ..... A63B 71/0605 700/91
2015/0159846 A1 * 6/2015 Hollinger ..... H04N 5/23206 362/183
2015/0159858 A1 * 6/2015 Lin ..... A63B 43/06 362/551
2016/0354665 A1 * 12/2016 Greenwalt ..... G09B 19/0038

* cited by examiner

LUMINOUS BALL WITH REMOTE ACTIVATION CAPABILITY

CROSS-REFERENCE TO RELATED PATENT APPLICATION

This application claims the benefit of priority to Taiwan Patent Application No. 107138994, filed on Nov. 2, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a luminous ball, in particular, to a luminous ball with remote activation capability.

BACKGROUND OF THE DISCLOSURE

In order to allow ball sports to proceed at night or in the dark, some luminous balls on the market serve a useful purpose in playing baseball or softball in areas where the lighting is insufficient. However, compared with a regular, non-luminous ball, the structure of the luminous ball needs to be largely changed for replacement of batteries. While leaving a battery-sized cut on the covering, for example, allows easy battery replacement, the characteristics and specifications of the ball are altered accordingly, making the appearance and texture of luminous balls greatly different from that of regular baseballs or softballs. Moreover, these luminous balls also do not have remote activation capabilities.

SUMMARY OF THE DISCLOSURE

One of the objectives of the present disclosure is to provide a luminous ball with remote activation capability that can overcome the aforementioned issues.

In one aspect, the present disclosure provides a luminous ball with remote start capability, including a sphere, a cover and a light-emitting device. The sphere is made of a light-transmissive material. The cover is wrapped around an external circumferential surface of the sphere and is made of a light-transmissive material. At least one seam is formed on the cover, and a plurality of seam apertures are disposed in pairs along two sides of the at least one seam. The light-emitting device is disposed in the sphere and includes a light-emitting unit, a power unit, a wireless transmitter-receiver unit and a main control unit. The main control unit is electrically connected to the light-emitting unit, the power unit and the wireless transmitter-receiver unit and operably configured to provide an electrical connection between the light-emitting unit and the power unit after obtaining an activation signal received by the wireless transmitter-receiver unit such that light emitted by the light-emitting unit penetrate the sphere and the cover and are visible through the at least one seam and the plurality of seam apertures.

Preferably, the main control unit includes a ring-shaped main board, the light-emitting unit includes a plurality of LEDs, and the plurality of LEDs are disposed at top and bottom sides of the ring-shaped main board.

Preferably, the power unit includes a battery holder and at least one battery, the battery holder has a base, two brackets, a first contact piece and a second contact piece, the base is placed into a through hole of the ring-shaped main board, the two brackets are extended outward from the base and fixed to the ring-shaped main board, the at least one battery is placed inside the base, and the first contact piece and the second contact piece are respectively configured to elastically contact a negative electrode and a positive electrode of the at least one battery.

Preferably, the first contact piece has a first fixing portion fixed on the top side of the ring-shaped main board and a first elastic contact portion that connects to the first fixing portion, spans across the top of the base, and elastically contacts the negative electrode of the at least one battery. The second contact piece has a second fixing portion fixed on the bottom side of the ring-shaped main board and a second elastic contact portion that connects to the second fixing portion, spans across the bottom of the base, and elastically contacts the positive electrode of the at least one battery.

Preferably, the wireless transmitter-receiver unit includes an infrared-receiving tube electrically connected to the ring-shaped main board and operably configured to receive the activation signal, and the activation signal is an infrared signal emitted from a remote control or a mobile phone.

Preferably, the sphere has a light input through hole and the light input through hole corresponding to a position of the infrared-receiving tube.

Preferably, the luminous ball further includes a removable pull handle having a handle portion and an insert portion extending from the handle portion, the handle portion is exposed outside the sphere, and the insert portion is inserted into the light input through hole.

Preferably, the wireless transmitter-receiver unit includes an RFID tag reader electrically connected to the ring-shaped main board, the RFID tag reader is configured to receive the activation signal, and the activation signal is an identification signal sent from an RFID tag.

Preferably, the luminous ball further includes a vibration switch electrically connected to the wireless transmitter-receiver unit, the vibration switch is configured to activate the wireless transmitter-receiver unit when the sphere is shaken, and turn off the wireless transmitter-receiver unit when the sphere is static for a period of time.

Preferably, an interior of the sphere is provided with a pressure-dispersive structure, the pressure-dispersive structure includes a plurality of interconnected vertical plates and horizontal plates made of high-strength and high-hardness materials, and the plurality of interconnected vertical plates and horizontal plates each has a Shore D hardness of 30 to 80.

Preferably, an interior of the sphere is provided with a pressure-dispersive structure, and the pressure-dispersive structure has a honeycomb-like structure.

Preferably, the sphere is made of a transparent elastic material.

Preferably, the pressure-dispersive structure is provided with a light-guiding powder that is evenly distributed throughout the plurality of interconnected vertical plates and horizontal plates.

Preferably, the sphere is provided with a transparent waterproof layer that is formed on the external circumferential surface of the sphere.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
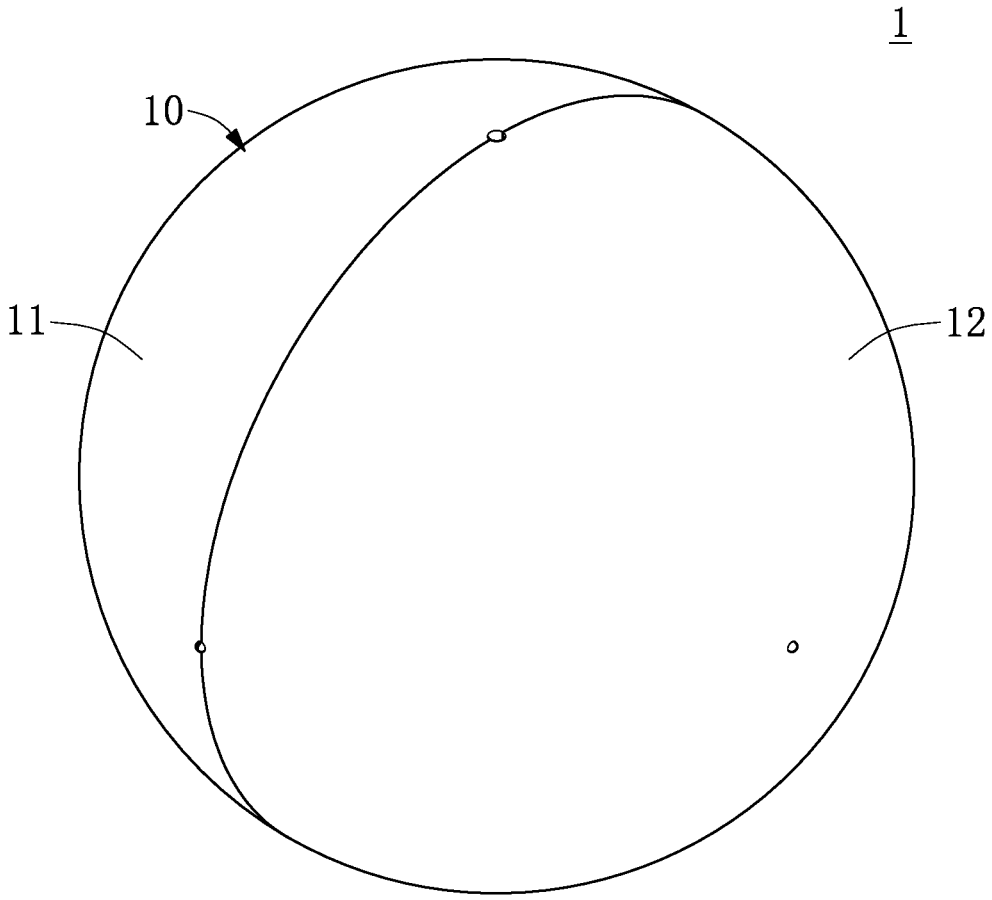
FIG. 1 is a perspective view of a luminous ball of a first embodiment of the present disclosure.
Figure 2:
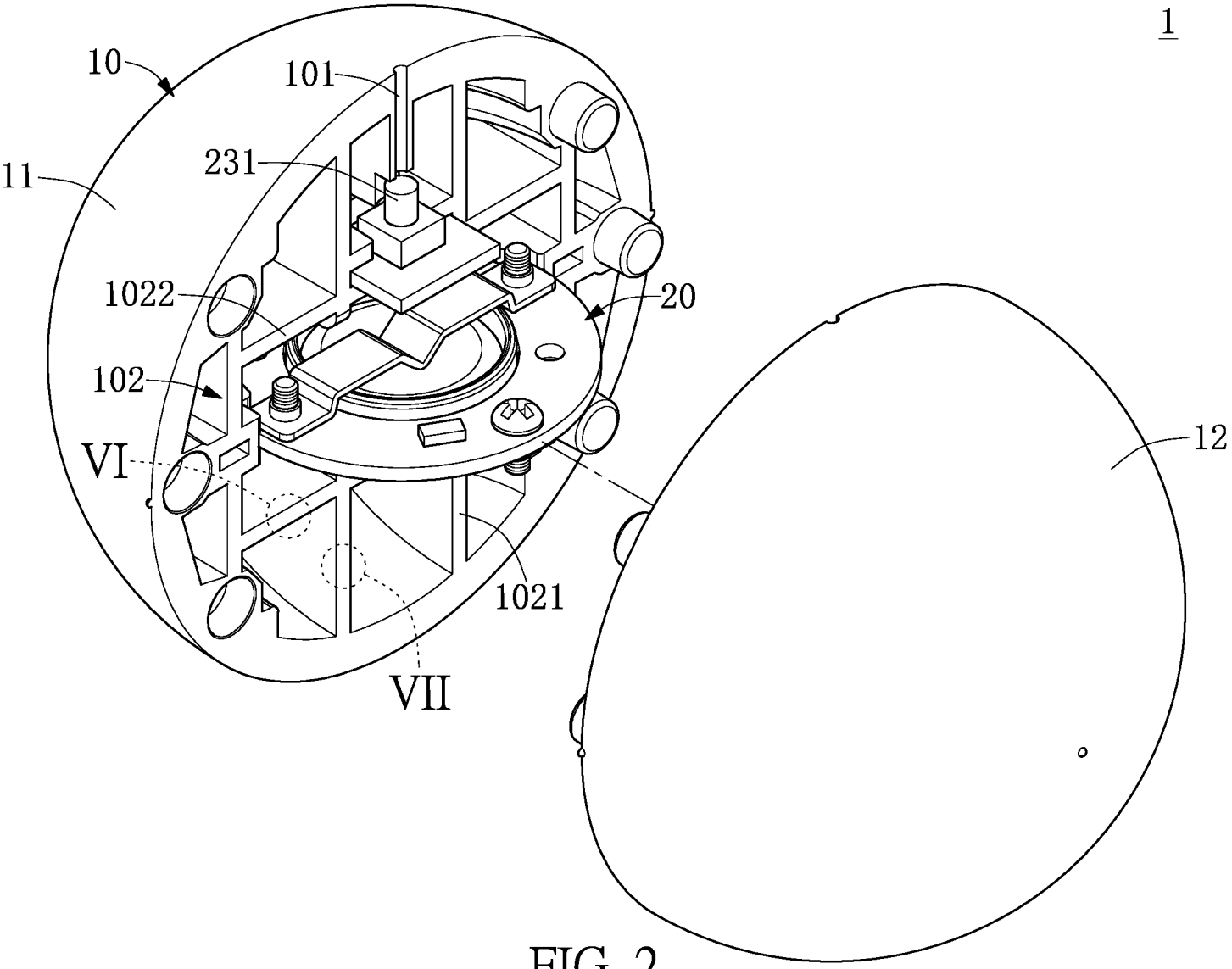
FIG. 2 is a partial exploded view of a luminous ball of the first embodiment of the present disclosure.
Figure 3:
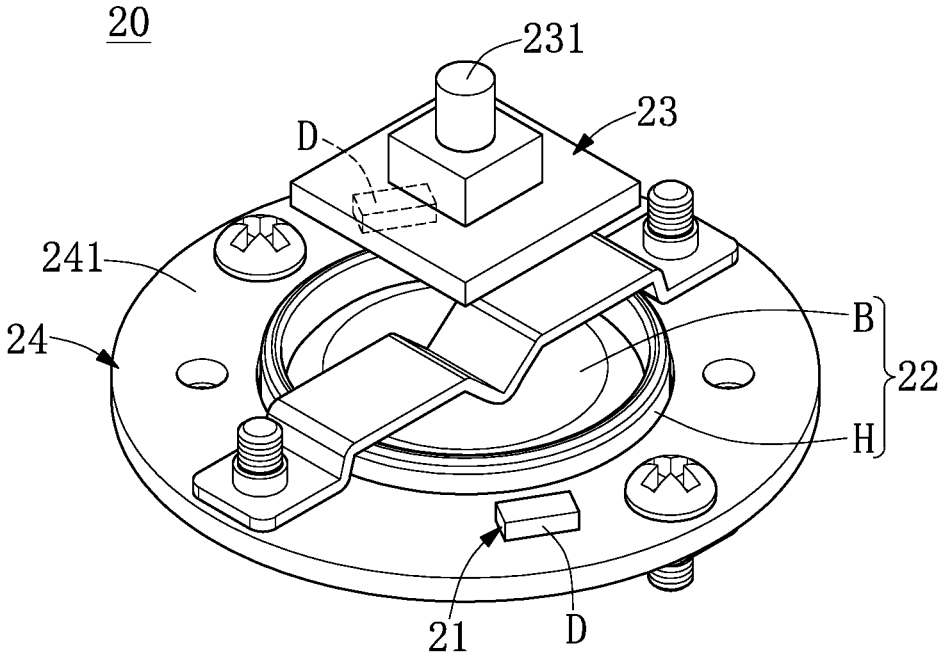
FIG. 3 is a perspective view of a light-emitting device of the first embodiment of the present disclosure.
Figure 4:
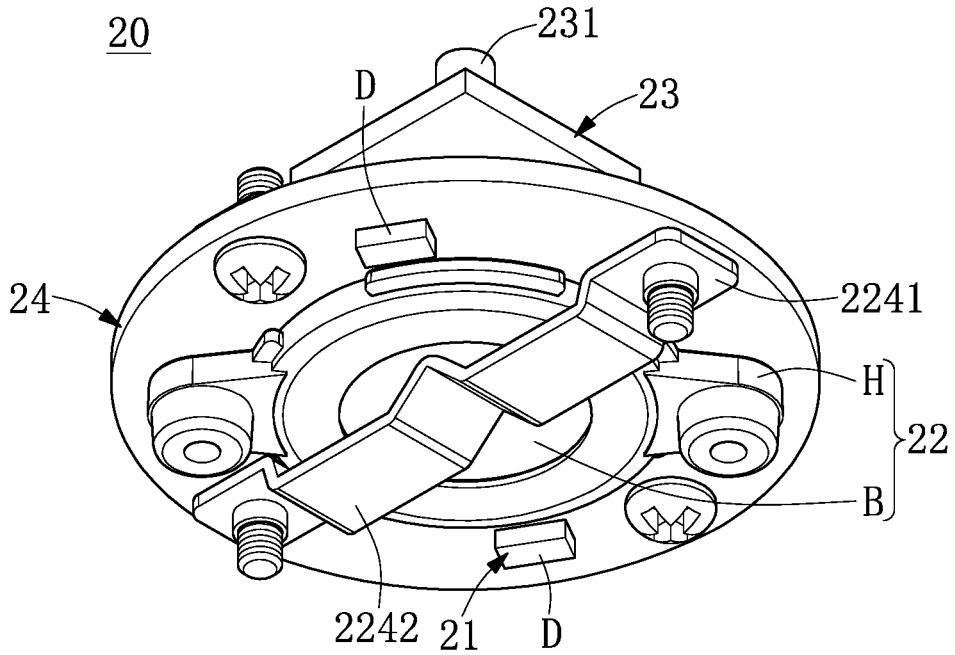
FIG. 4 is another perspective view of a light-emitting device of the first embodiment of the present disclosure.
Figure 5:
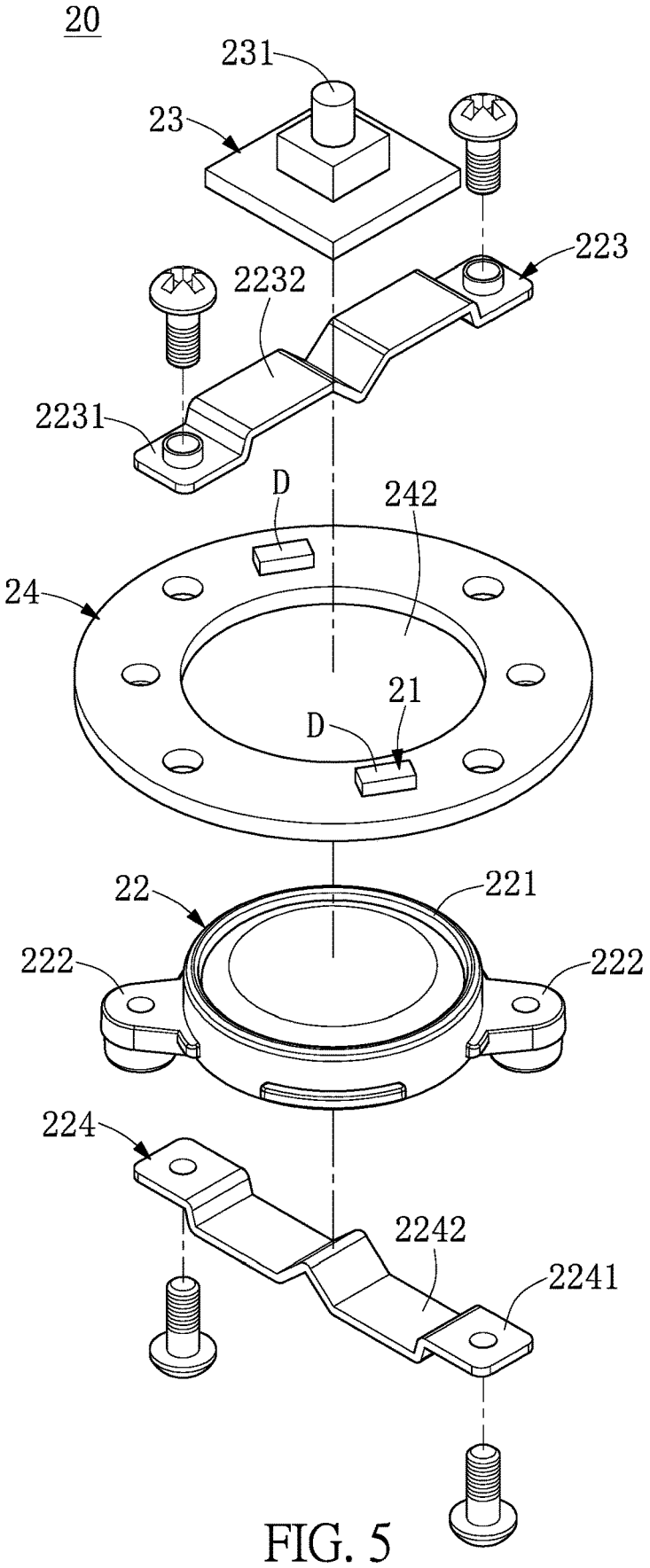
FIG. 5 is a partial exploded view of a light-emitting device of the first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 7, the present disclosure provides a luminous ball with remote activation capability 1 (hereinafter referred to as the luminous ball).

The luminous ball 1 mainly includes a sphere 10 and a light-emitting device 20 disposed in the sphere 10.

The sphere 10 can be but is not limited to being made of a transparent elastic material. In order to retain the likeness in ball handling and hitting of the luminous ball 1 of the present disclosure and a conventional hard baseball or softball, the sphere 10 is designed to have a similar diameter and material as the conventional hard baseball or softball, so that the sphere 10 of the luminous ball can have the same weight and elastic coefficient as the regular baseball/softball. In some embodiments, the sphere 10 may be made of a soft material in order to form a safety ball. In addition, the sphere 10 may be made of thermoplastic polyurethane (TPU). In this embodiment, the sphere 10 has a first hemisphere 11 and a second hemisphere 12 that are assembled to each other. Further, the first hemisphere 11 and the second hemisphere 12 may be joined by melting to form an integral piece.

The light-emitting device includes a light-emitting unit 21, a power unit 22, a wireless transmitter-receiver unit 23, and a main control unit 24. The main control unit 24 is electrically connected to the light-emitting unit 21, the power unit 22, and the wireless transmitter-receiver unit 23.

In this embodiment, the main control unit 24 includes a ring-shaped main board 241, and there may be one or more microprocessors on the main board 241. The light-emitting unit 21 includes a plurality of LEDs D that are disposed at top and bottom sides of the main board 241, thereby allowing the light-emitting unit 21 to illuminate from the top and bottom at the same time for a more even illumination.

The electrical connection between the light-emitting unit 21 and the power unit 22 can be selectively established, enabling the power unit 22 to supply power to the light-emitting unit 21. In this embodiment, the power unit 22 includes a battery holder H and at least one battery B. In detail, the battery holder H has a base 221, two brackets 222, a first contact piece 223, and a second contact piece 224. The base 221 can be placed into a through hole 242 of the ring-shaped main board 241. The two brackets 222 are extended outward from the base 221 and fixed to the ring-shaped main board 241. The at least one battery B is placed inside the base 221, and the first contact piece 223 and the second contact piece 224 are respectively configured to elastically contact the negative electrode and the positive electrode of the at least one battery B.

The first contact piece 223 has a first fixing portion 2231 and a first elastic contact portion 2232 connected to the first fixing portion 2231. The first fixing portion 2231 is fixed on the top side of the ring-shaped main board 241 by screw. The first elastic contact portion 2232 spans across the top of the base 221 and elastically contacts the negative electrode of the at least one battery B. The second contact piece 224 has a second fixing portion 2241 and a second elastic contact portion 2242 connected to the second fixing portion 2241. The second fixing portion 2241 is fixed on the bottom side of the ring-shaped main board 241 by screw. The second elastic contact portion 2242 spans across the bottom of the base 221 and elastically contacts the positive electrode of the at least one battery B. Furthermore, the first elastic contact portion 2232 has a V-shaped portion and the second elastic contact portion 2242 has an inverted V-shaped portion that allows the first elastic contact portion 2232 and the second elastic contact portion 2242 to better elastically contact the negative electrode and the positive electrode of the at least one battery B. In this embodiment, the specification and the number of the battery B are not limited. The battery B may preferably be a button cell (LR50).

The wireless transmitter-receiver unit 23 can be disposed directly on the main board 241 or electrically connected to the main board 241 through a wire, and is not limited thereto. In this embodiment, the wireless transmitter-receiver unit 23 can be an infrared receiver and may include an infrared-receiving tube 231 electrically connected to the main board 241, so as to receive the activation signal. Furthermore, the foregoing activation signal may be an infrared signal emitted from a remote control or a mobile phone having an infrared emitter. In addition, in order to prevent the input of other interference signals, the sphere 10 has a light input through hole 101, and the light input through hole 101 corresponds to the position of infrared-receiving tube 231, so that the remote control or the mobile phone having the infrared emitter must be pointed straight toward the light input through hole 101 to emit the activation signal, so as to avoid the input of other interference signals and cause erroneous actions.

Further, once the wireless transmitter-receiver unit 23 receives the activation signal, the activation signal will be immediately sent to the main control unit 24. After the main control unit 24 obtains the activation signal received by the wireless transmitter-receiver unit 23, the electrical connection between the light-emitting unit 21 and power unit 22 will be provided, thereby enabling the light-emitting unit 21 to emit light that emanates through the sphere 10.

In addition, the wireless transmitter-receiver unit 23 can also be used to receive control signals. Once the wireless transmitter-receiver unit 23 receives the control signal, the control signal will be immediately sent to the main control unit 24. The main control unit 24 controls the color or brightness emitted by the light-emitting unit 21 after obtaining the control signal received by the wireless transmitter-receiver unit 23.

Figure 6:
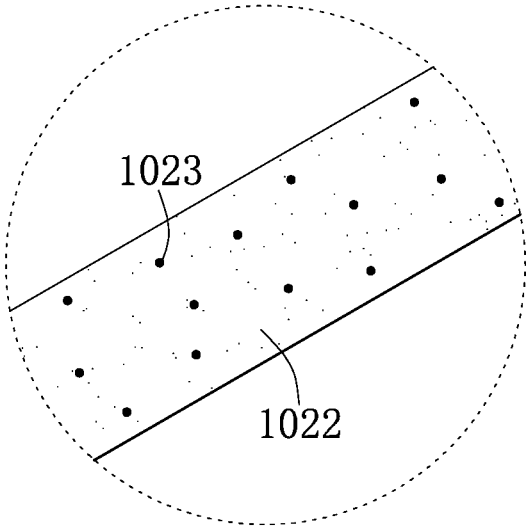
FIG. 6 is an enlarged view showing a portion VI of FIG. 2 in more detail.
Figure 7:
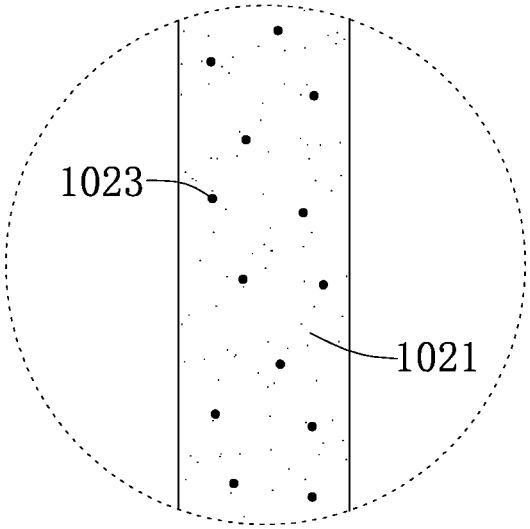
FIG. 7 is an enlarged view showing a portion VII of FIG. 7 in more detail.

In this embodiment, the interior of the sphere 10 is provided with a pressure-dispersive structure 102 to enhance the ability of the sphere 10 to withstand impact. In detail, the pressure-dispersive structure 102 includes a plurality of interconnected vertical plates 1021 and horizontal plates 1022, thereby dispersing the impact force applied around the sphere 10. The plurality of interconnected vertical plates 1021 and horizontal plates 1022 can be made of high-strength and high-hardness materials, meaning that the exterior of the sphere 10 is more flexible, and the interior of the sphere 10 is high-strength and high-hardness. The plurality of interconnected vertical plates 1021 and horizontal plates 1022 may each have a Shore D hardness of 30 to 80. Meanwhile, the light-emitting device 20 is located inside and at the center of the sphere 10, and passes through the pressure-dispersive structure 102 to enhance the ability of the light-emitting device 20 to withstand impact. The vertical plate 1021 and horizontal plate 1022 of the pressure-dispersive structure 102 can also be used to adjust the weight and elastic force of the sphere 10, thereby enabling the sphere 10 to have a weight and elastic force that are the same as those of the regular baseball/softball. In addition, as shown in FIG. 6 and FIG. 7, the pressure-dispersive structure 102 is provided with a light-guiding powder 1023 that is evenly distributed throughout the plurality of interconnected vertical plates 1021 and horizontal plates 1022, so that light that penetrates through the vertical plates 1021 and horizontal plates 1022 is soft and evenly distributed. Furthermore, when one of the LEDs D is damaged, the light of other LEDs D will be guided by the vertical plates 1021 and horizontal plates 1022, so that the spherical surface corresponding to the damaged LED D will not be completely dark. Furthermore, the main board 241 has a backup mode for providing backup power supply to LEDs, so that when one of the LEDs D is damaged, the other LEDs D will still be lit. In addition, the main board 241 has a multi-layer board structure to enhance its ability to withstand impact.

Second Embodiment

Figure 8:
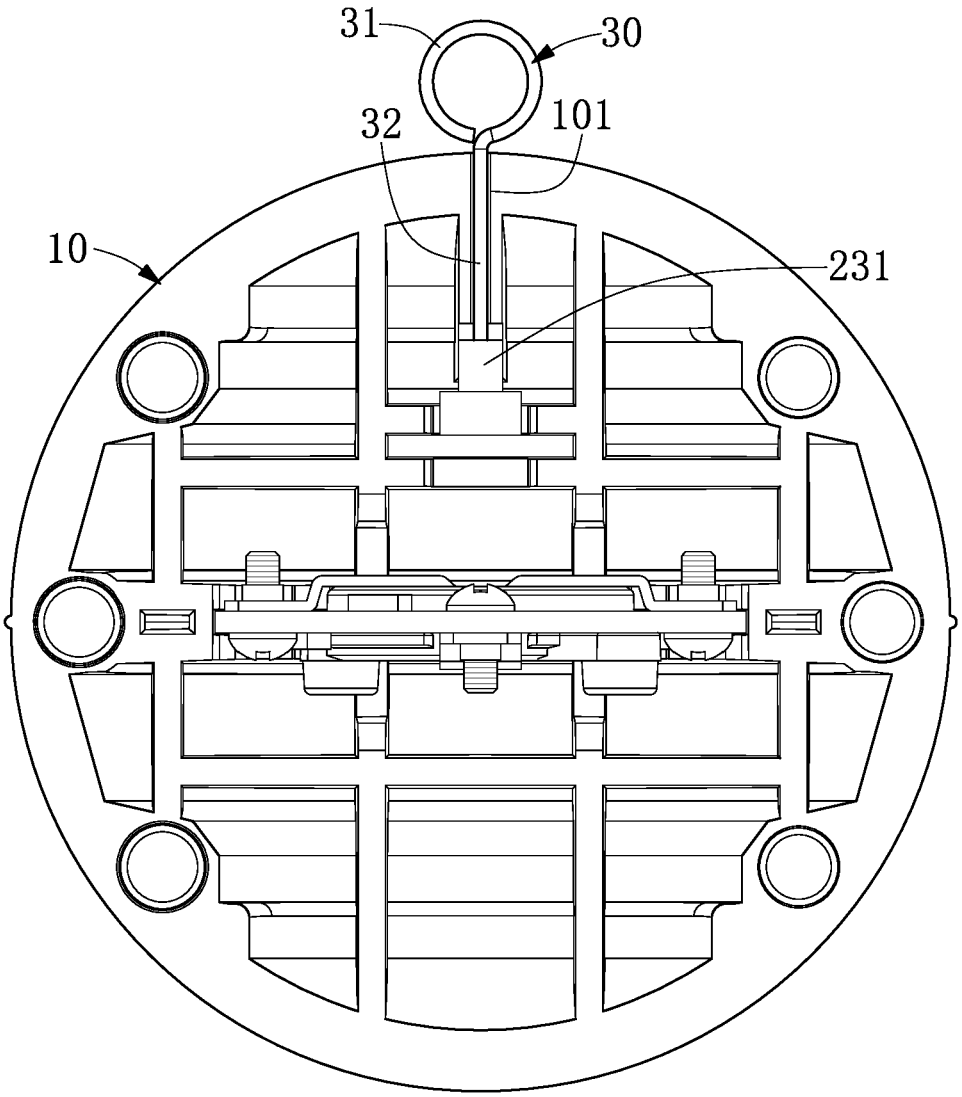
FIG. 8 is a partial plan view of a luminous ball of a second embodiment of the present disclosure.

FIG. 8 illustrates the second embodiment of the present disclosure. In the present embodiment, the luminous ball further includes a removable pull handle 30. The removable pull handle 30 has a handle portion 31 and an insert portion 32 extended from the handle portion 31. The handle portion 31 is exposed outside the sphere 10, and the insert portion 32 is inserted into the light input through hole 101. Therefore, it is necessary to remove the removable pull handle 30 before using the luminous ball as the remote control or the mobile phone to point toward the light input through hole 101 and transmit the activation signal to the infrared-receiving tube 231, so as to activate the luminous ball.

Third Embodiment

Figure 9:
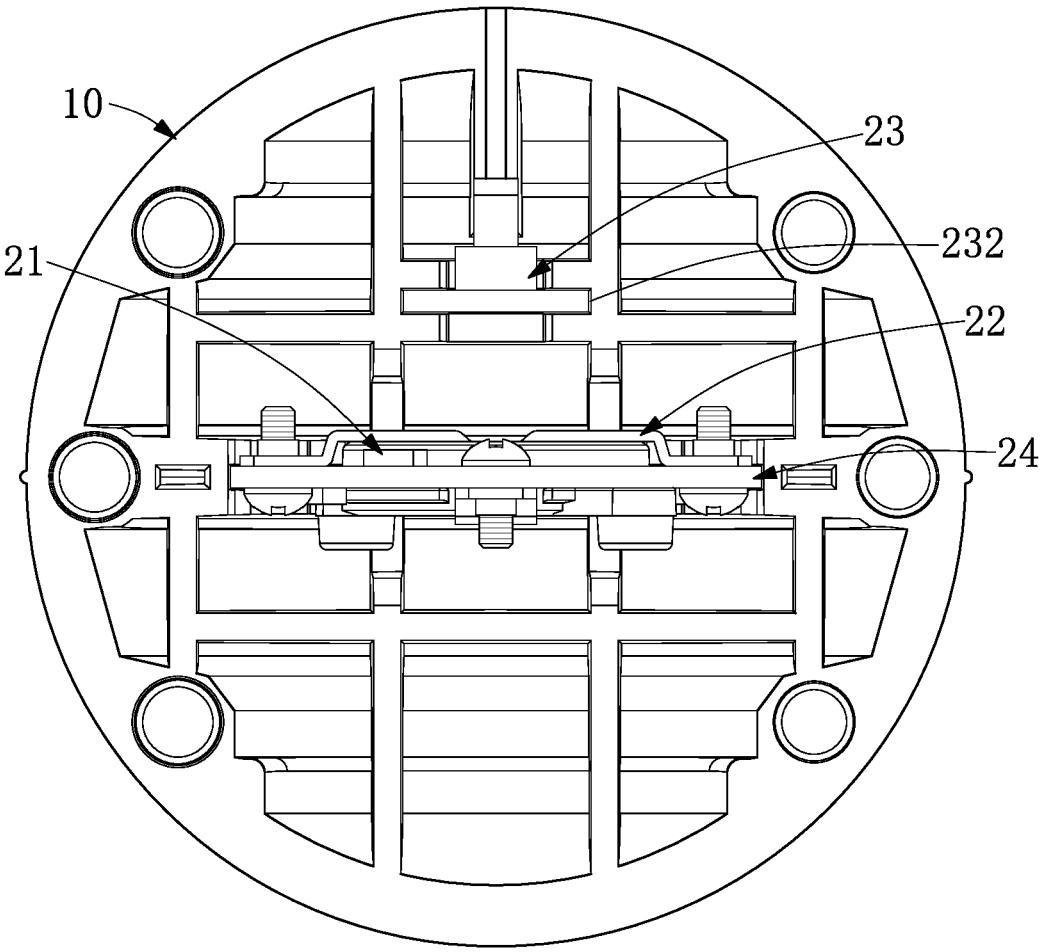
FIG. 9 is a partial plan view of a luminous ball of a third embodiment of the present disclosure.

FIG. 9 illustrates the third embodiment of the present disclosure. In the present embodiment, the wireless transmitter-receiver unit 23 includes an RFID tag reader 232 electrically connected to the main board 241 and configured to receive the activation signal. Therefore, when a user holding the corresponding RFID tag approaches the luminous ball, the RFID tag reader 232 can receive the identification signal from the RFID tag as the activation signal.

Furthermore, once the wireless transmitter-receiver unit 23 receives the activation signal, the activation signal will be immediately sent to the main control unit 24. After the main control unit 24 obtains the activation signal received by the wireless transmitter-receiver unit 23, the electrical connection between the light-emitting unit 21 and power unit 22 will be provided, thereby enabling the light-emitting unit 21 to emit light that penetrates through the sphere 10.

Fourth Embodiment

Figure 10:
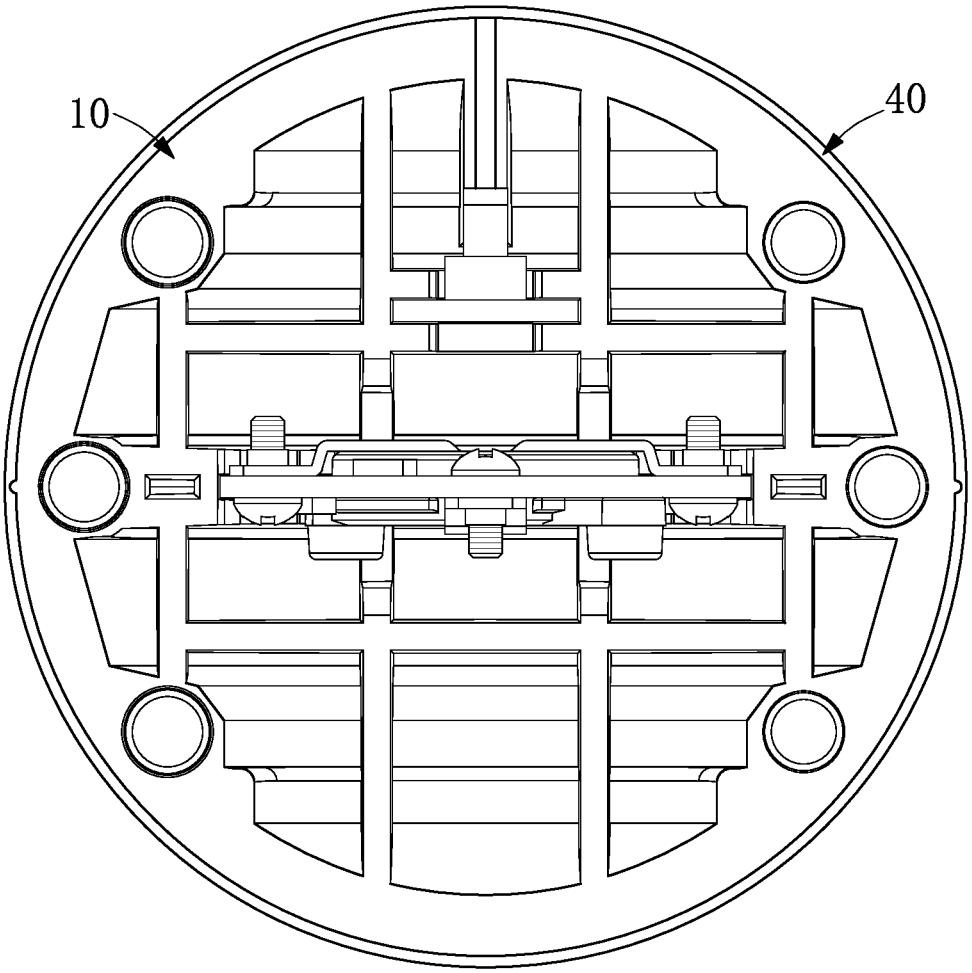
FIG. 10 is a partial plan view of a luminous ball of a fourth embodiment of the present disclosure.

FIG. 10 illustrates the fourth embodiment of the present disclosure. In the present embodiment, the sphere 10 is provided with a transparent waterproof layer 40 such as a waterproof film. The transparent waterproof layer 40 is formed on the external circumferential surface of the sphere 10, thereby increasing the strength and the water repellency thereof.

Fifth Embodiment

Figure 11:
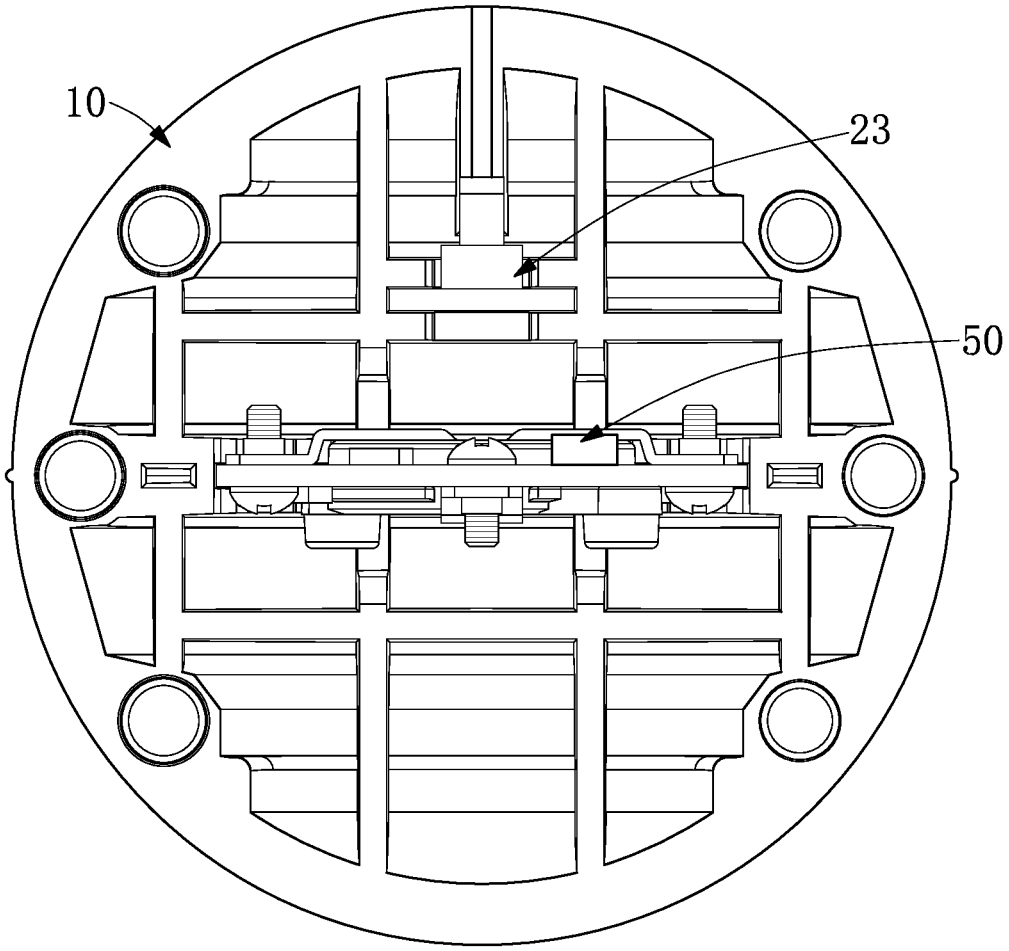
FIG. 11 is a partial plan view of a luminous ball of a fifth embodiment of the present disclosure.

FIG. 11 illustrates the fifth embodiment of the present disclosure. In the present embodiment, the luminous ball further includes a vibration switch 50. The vibration switch 50 is electrically connected to the wireless transmitter-receiver unit 23 and configured to activate the wireless transmitter-receiver unit 23 when the sphere 10 is shaken. The wireless transmitter-receiver unit 23 will be turned off when the sphere 10 is static for a period of time. In this way, in addition to preventing the wireless transmitter-receiver unit 23 from being interfered by other signals, power saving can also be achieved.

Sixth Embodiment

Figure 12:
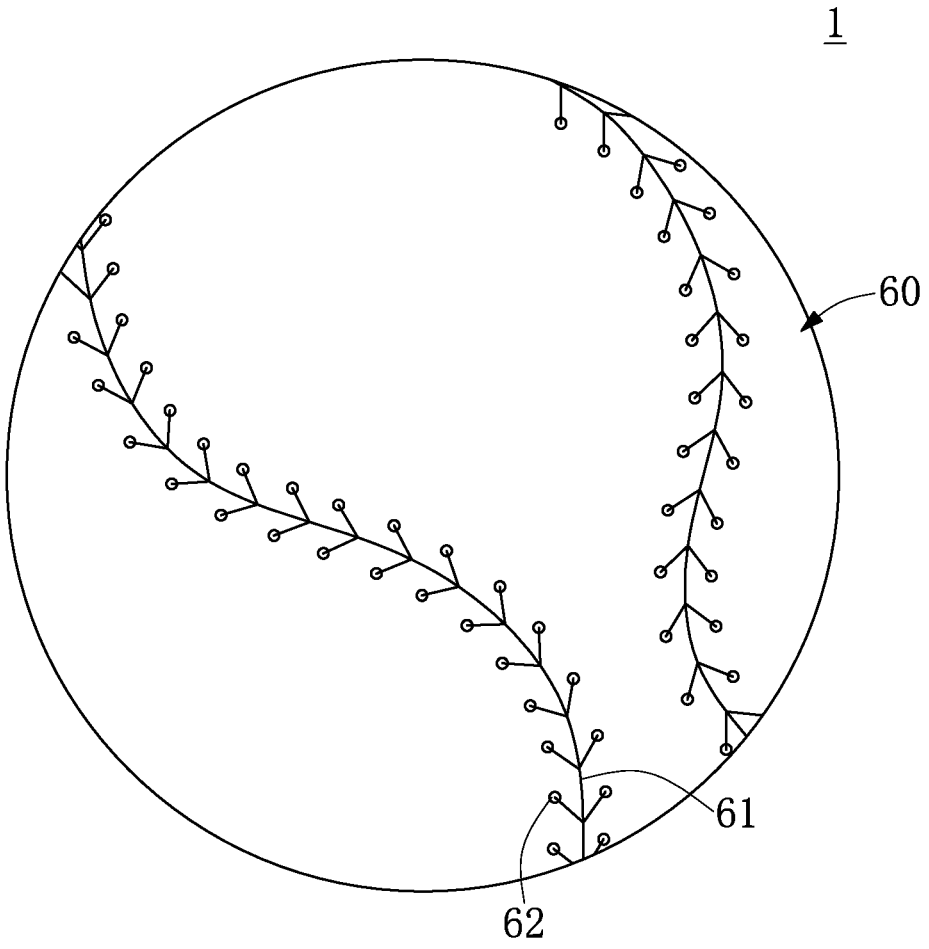
FIG. 12 is a perspective view of a luminous ball of a sixth embodiment of the present disclosure.

FIG. 12 illustrates the sixth embodiment of the present disclosure. In the present embodiment, the luminous ball further includes a cover 60 that can be similar to the surface material of a baseball. Furthermore, the cover 60 can be made of a light-transmissive material. The cover 60 can wrap the external circumferential surface of the sphere 10 as shown in FIG. 1 to form the luminous ball 1 as shown in FIG. 12. In addition, at least one seam 61 is formed on the cover 60, and a plurality of seam apertures 62 are disposed in pairs along two sides of the at least one seam 61. Therefore, lights are visible through the at least one seam 61 and the seam apertures 62, or the cover 60. As such, the user can clearly see the motion trajectory and rotation path of the luminous ball 1 in dim light at night through the light which is visible through the surface of the luminous ball 1.

Seventh Embodiment

Figure 13:
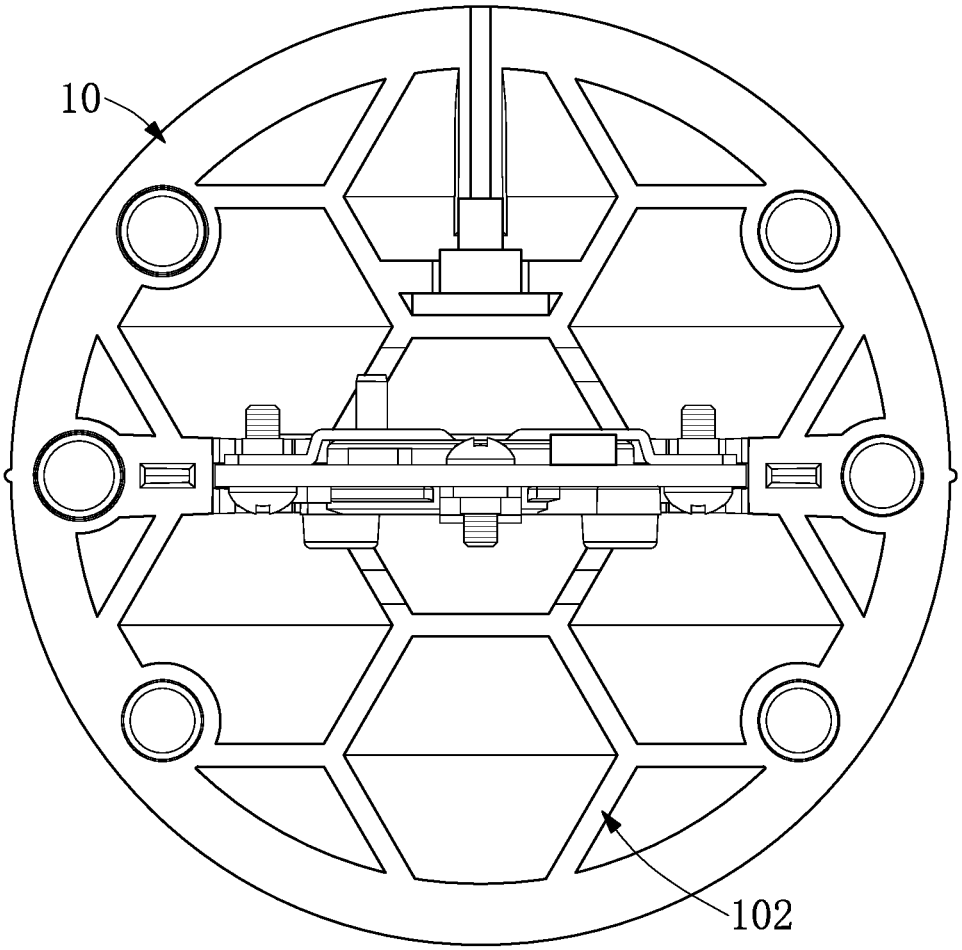
FIG. 13 is a partial plan view of a luminous ball of a seventh embodiment of the present disclosure.

FIG. 13 illustrates the seventh embodiment of the present disclosure. In the present embodiment, the interior of the sphere 10 is provided with a pressure-dispersive structure 102. The pressure-dispersive structure 102 has a honeycomb-like structure. That is, the pressure-dispersive structure 102 includes a plurality of plates arranged in a honeycomb-like structure to enhance the ability of the sphere 10 to withstand impact.

In summary, the advantages of the present disclosure are at least that the luminous ball has a wireless transmitter-receiver unit, so that the corresponding remote control can wirelessly activate and control the luminous ball. Furthermore, when the luminous ball is not in use, the corresponding remote control can wirelessly turn off the luminous ball to prolong battery life.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A luminous ball with remote activation capability, comprising:

a sphere made of a light-transmissive material;

a cover wrapping around an external circumferential surface of the sphere and made of a light-transmissive material, wherein at least one seam is formed on the cover, and a plurality of seam apertures are disposed in pairs along two sides of the at least one seam; and a light-emitting device disposed in the sphere and including a light-emitting unit, a power unit, a wireless transmitter-receiver unit and a main control unit, wherein the main control unit is electrically connected to the light-emitting unit, the power unit and the wireless transmitter-receiver unit and operably configured to provide an electrical connection between the light-emitting unit and the power unit after obtaining an activation signal received by the wireless transmitter-receiver unit such that light emitted by the light-emitting unit penetrates the sphere and the cover and is visible through the at least one seam and the plurality of seam apertures;

wherein the main control unit includes a ring-shaped main board, the light-emitting unit includes a plurality of LEDs, and the plurality of LEDs are disposed at top and bottom sides of the ring-shaped main board, and wherein the power unit includes a battery holder and at least one battery, the battery holder has a base, two brackets, a first contact piece and a second contact piece, the base is placed into a through hole of the ring-shaped main board, the two brackets are extended outward from the base and fixed to the ring-shaped main board, the at least one battery is placed inside the base, and the first contact piece and the second contact piece are respectively configured to elastically contact a negative electrode and a positive electrode of the at least one battery.

2. The luminous ball with remote activation capability according to claim 1, wherein the first contact piece has a first fixing portion fixed on the top side of the ring-shaped main board, and a first elastic contact portion that connects to the first fixing portion, spans across the top of the base, and elastically contacts the negative electrode of the at least one battery, and wherein the second contact piece has a second fixing portion fixed on the bottom side of the ring-shaped main board, and a second elastic contact portion that connects to the second fixing portion, spans across the bottom of the base, and elastically contacts the positive electrode of the at least one battery.

3. The luminous ball with remote activation capability according to claim 1, wherein the wireless transmitter-receiver unit includes an infrared-receiving tube electrically connected to the ring-shaped main board and operably configured to receive the activation signal, and the activation signal is an infrared signal emitted from a remote control or a mobile phone.

4. The luminous ball with remote activation capability according to claim 3, wherein the sphere has a light input through hole, and the light input through hole corresponds to a position of the infrared-receiving tube.

5. The luminous ball with remote activation capability according to claim 4, further comprising:

a removable pull handle having a handle portion and an insert portion extending from the handle portion, wherein the handle portion is exposed outside the sphere, and the insert portion is inserted into the light input through hole.

6. The luminous ball with remote activation capability according to claim 1, wherein the wireless transmitter-receiver unit includes an RFID tag reader electrically connected to the ring-shaped main board, the RFID tag reader is configured to receive the activation signal, and the activation signal is an identification signal sent from an RFID tag.

7. The luminous ball with remote activation capability according to claim 1, further comprising:

a vibration switch electrically connected to the wireless transmitter-receiver unit, wherein the vibration switch is configured to activate the wireless transmitter-receiver unit when the sphere is shaken, and turn off the wireless transmitter-receiver unit when the sphere is static for a period of time.

8. The luminous ball with remote activation capability according to claim 1, wherein an interior of the sphere is provided with a pressure-dispersive structure, the pressure-dispersive structure includes a plurality of interconnected vertical plates and horizontal plates made of high-strength and high-hardness materials, and the plurality of interconnected vertical plates and horizontal plates each has a Shore D hardness of 30 to 80.

9. The luminous ball with remote activation capability according to claim 1, wherein an interior of the sphere is provided with a pressure-dispersive structure, and the pressure-dispersive structure has a honeycomb-like structure.

10. The luminous ball with remote activation capability according to claim 1, wherein the sphere is made of a transparent elastic material.

11. The luminous ball with remote activation capability according to claim 8, wherein the pressure-dispersive structure is provided with a light-guiding powder that is evenly distributed throughout the plurality of interconnected vertical plates and horizontal plates.

12. The luminous ball with remote activation capability according to claim 1, wherein the sphere is provided with a transparent waterproof layer that is formed on the external circumferential surface of the sphere.

* * * * *